United States Patent [19]

Spiller

[11] 4,236,262

[45] Dec. 2, 1980

[54] SUPPORT GRID AND SPRING UNIT FOR A BOX SPRING FOUNDATION UNIT

[75] Inventor: Rex S. Spiller, Sheboygan, Wis.

[73] Assignee: Spiller Spring Company, Sheboygan, Wis.

[21] Appl. No.: 7,938

[22] Filed: Jan. 31, 1979

[51] Int. Cl.[3] ..... A47C 23/04; A47C 23/145

[52] U.S. Cl. ..... 5/267; 5/257; 5/478

[58] Field of Search ..... 5/248, 256, 257, 260, 5/265, 267, 273, 277, 478

[56] References Cited

U.S. PATENT DOCUMENTS

| | | | |
|---|---|---|---|
| 819,671 | 1/1906 | Pennepack | 5/267 |
| 1,155,425 | 10/1915 | King | 5/267 |
| 2,418,697 | 4/1947 | Caughey | 5/267 |
| 3,270,354 | 9/1966 | Ciampa | 5/260 |
| 3,660,854 | 5/1972 | Garceau | 5/267 |
| 3,662,411 | 5/1972 | Garceau | 5/266 |
| 3,789,440 | 2/1974 | Garceau | 5/256 |
| 3,864,765 | 2/1975 | Anonauer | 5/266 |
| 3,953,212 | 5/1976 | Lawrence et al. | 5/267 |
| 4,068,330 | 1/1978 | Rakow et al. | 5/267 |
| 4,112,528 | 9/1978 | Higgins | 5/267 |
| 4,114,330 | 9/1978 | Krakauer | 5/267 |

*Primary Examiner*—Casmir A. Nunberg

*Attorney, Agent, or Firm*—Merriam, Marshall & Bicknell

[57] ABSTRACT

A grid structure for engaging and supporting a plurality of coil springs in predetermined spatial relationships so that spring units and completed box spring foundation units can be produced having different numbers of coil springs and consequently different degrees of firmness. The grids are constructed in sizes approximating the dimensions of standard size box spring foundation units, and are formed from longitudinally and transversely extending groups of wires defining a plurality of generally rectangular seats arranged in rows and columns. The top coils of different numbers of coil springs can be engaged with and retained on selected seats in each row to provide the desired degree of firmness of the completed unit. The top coils are restrained against longitudinal and transverse shifting movement relative to their seats and the dimensions of the seats and top coils are such that the top coils can be mounted closely adjacent to each other without overlapping. Adjacent top coils are separated by only one longitudinally extending wire of the grid.

32 Claims, 8 Drawing Figures

FIG. 1
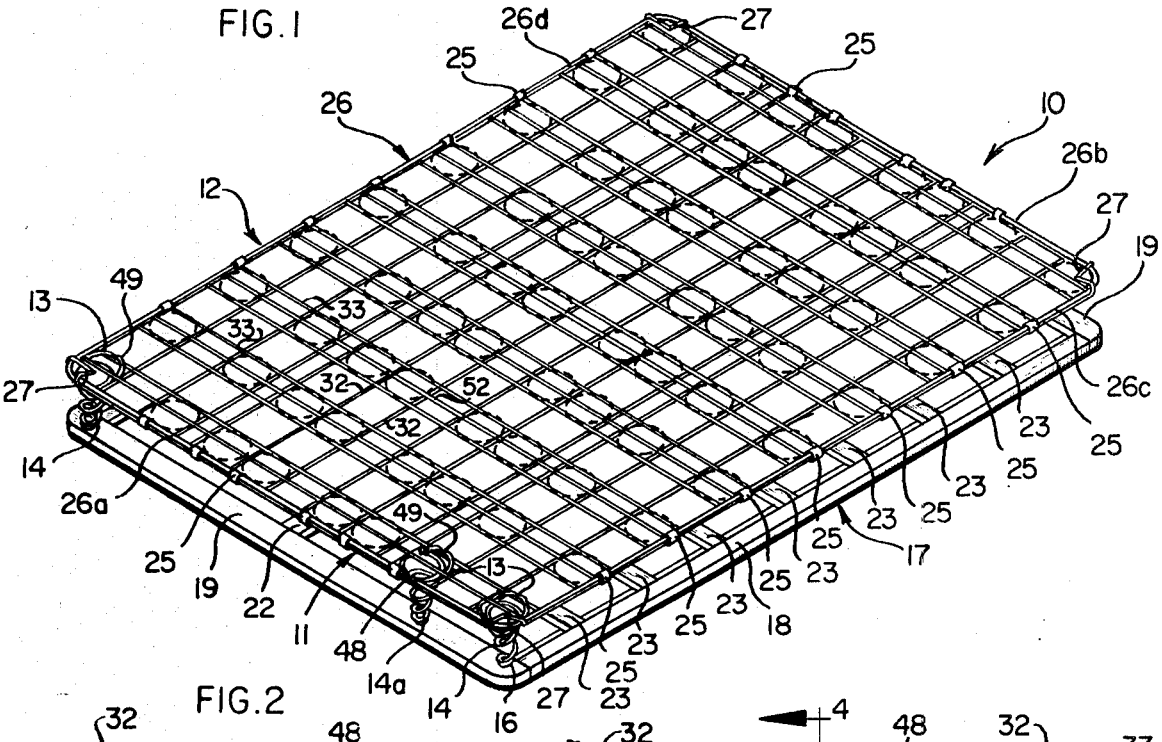
FIG. 2
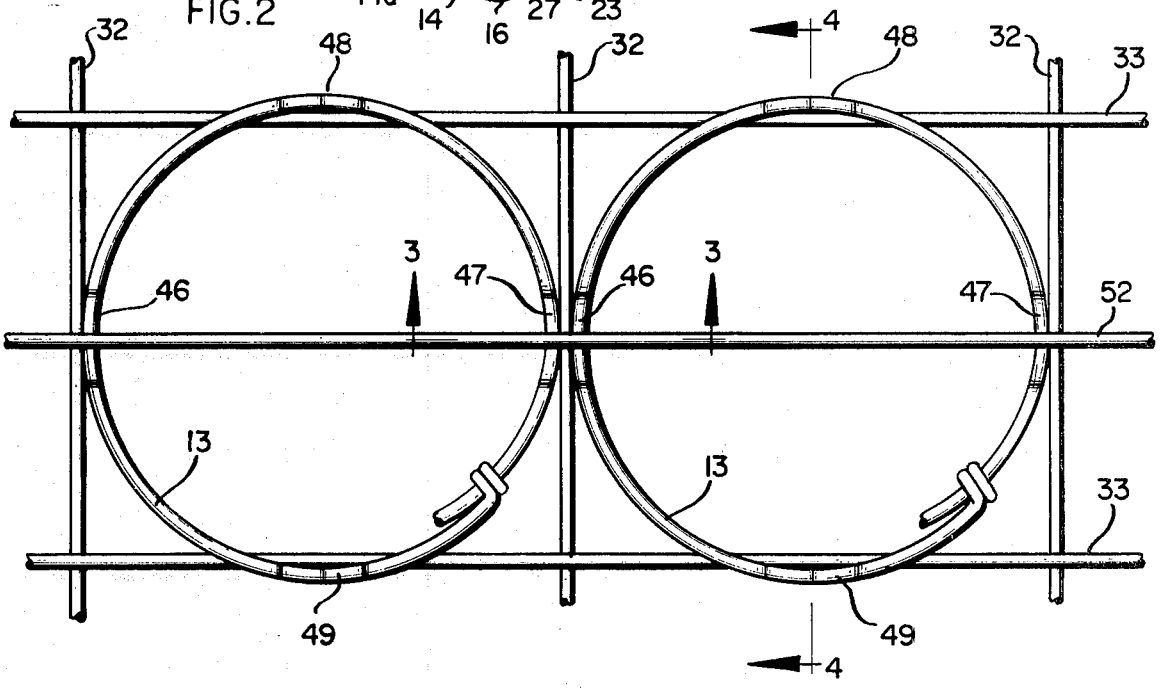
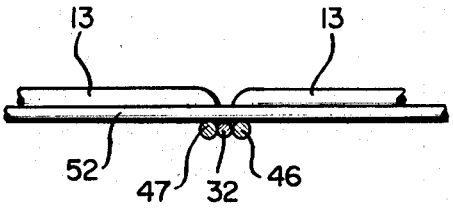
FIG. 3
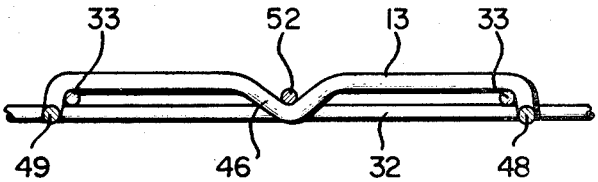
FIG. 4

SUPPORT GRID AND SPRING UNIT FOR A BOX SPRING FOUNDATION UNIT

This invention relates to a grid structure for engaging and retaining a plurality of coil springs in a predetermined spatial arrangement, and more particularly relates to a support grid and mounting arrangement for the coil springs of a spring unit such as is used in the manufacture of box spring foundation units, mattresses and other types of upholstered furniture.

Various types of spring units or assemblies have been heretofore developed which facilitate the manufacture of box springs, mattresses and other types of upholstered furniture and which reduce the time of assembly and cost of such units. Examples of such spring units wherein a grid structure is employed for engaging the upper coils of the coil springs of such units and wherein one or more of the wires of the grid are deformed so as to interlock with the top coils of the coil springs and thus retain the coils engaged with the grid and in predetermined pattern are disclosed in the Ciampa et al U.S. Pat. No. 3,270,354, Garceau U.S. Pat. No. 3,662,411, Garceau U.S. Pat. No. 3,789,440, Anonauer U.S. Pat. No. 3,864,765 and Lawrence et al U.S. Pat. No. 3,953,903.

In addition to deforming portions of the wires of the support grid so as to better interlock with the top coils of the coil springs, some of the prior art spring unit assemblies have also utilized locking wires which extend through deformed portions of the wires of the grid and engage portions of the top coil of the coil springs to improve the retention of the springs. Examples of spring units utilizing this type of construction are disclosed in the aforementioned Ciampa et al U.S. Pat. No. 3,270,354 and in the Garceau U.S. Pat. No. 3,660,854.

In an effort to simplify and reduce the costs of assembly of the spring units of the type herein contemplated, grid constructions and coil springs have been developed wherein the top coils of the coil springs are easily shiftable into interlocking engagement with the wires of the grid without the use of special tools, clips or welding. An example of this type of construction is disclosed in the Rakow et al U.S. Pat. No. 4,068,330.

While the spring units and grid constructions disclosed in the aforementioned patents have proved generally satisfactory for their intended purposes, many are objectionable from the standpoint that precise forming operations are required in the grids and/or top coils of the springs, which increases assembly time and production costs. In addition, the complexity of such constructions increases the possibility that squeaks or other undesirable noises will develop in the finished product when the latter is in use.

The cost of manufacturing spring units ofthe type herein contemplated has also been increased because it was necessary for manufacturers to maintain a large inventory of grids in different sizes and having different wire arrangements in each size so that spring units could be produced having different numbers of coil springs in each size in order to vary the degree of firmness of the completed box spring or mattress.

The present invention overcomes the aforementioned disadvantages and objections by providing a single grid structure for each size spring unit, which is capable of engaging the upper coils of different numbers of coil springs and retaining the springs in a predetermined spatial relationship so that different degrees of firmness can be obtained in the completed box spring, mattress or upholstered furniture item. Consequently, the spring unit manufacturer need only maintain an inventory of standardized support grids for each size of spring unit.

Other features and advantages of the invention will be apparent from the description which follows and accompanying drawings in which:

FIG. 1 is a perspective view of a spring unit embodying the features of the present invention and showing the spring unit mounted on a supporting frame;

FIG. 2 is an enlarged plan view of a portion of the grid structure of the spring unit illustrated in FIG. 1 and showing the engaged relationship of the top coils of a pair of coil springs with the grid structure when the unit is assembled;

FIG. 3 is a fragmentary, transverse sectional view taken along the line 3—3 of FIG. 2;

FIG. 4 is a longitudinal sectional view taken along the line 4—4 of FIG. 2;

Figure 6:
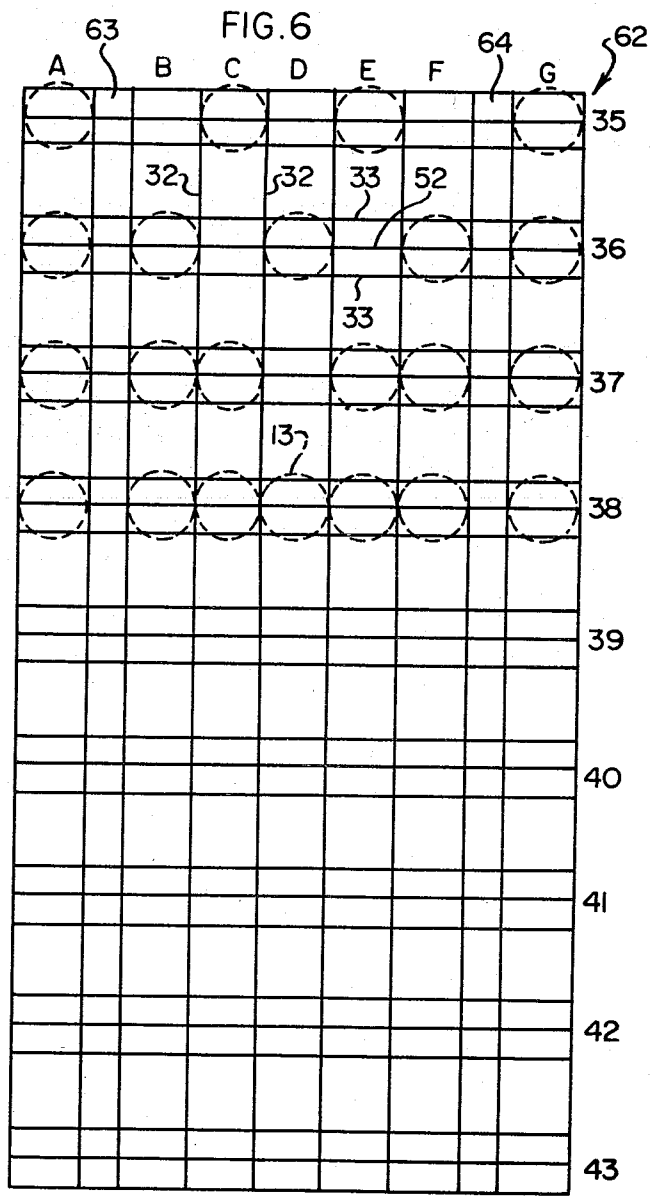
FIG. 6 is a diagrammatic plan view of another grid structure for a twin size box spring foundation unit and embodying the features of the present invention.

Briefly described, the present invention contemplates a novel grid construction for engaging the top or upper coils of the coil springs of a spring unit for a box spring, mattress or other upholstered furniture item, wherein first and second groups of longitudinally and transversely extending wires are joined together at their points of crossing to provide a plurality of generally rectangular seats. The seats are arranged in rows and columns and an odd number of seats are preferably provided in each row. Each row of seats may be divided into two or more sets and longitudinally aligned spaces may be provided between each set of seats so that the length and width of the grid are of such dimensions that the dimensions of the completed foundation unit in which the grid is employed are substantially equal to those of a standard size box spring, mattress or upholstered furniture item.

In the embodiments of the grid structure, to be hereinafter described in detail, the seats in each row of the grid are divided into three sets, one of the sets being centrally located in the grid. The other two sets include at least one seat and are disposed on opposite sides of the central set and separated therefrom by longitudinally aligned, spaces.

In the embodiment of the spring unit, to be hereinafter described in detail, a number of the seats in each row of the grid have common longitudinally extending portions and the longitudinal spacing of the transversely extending portions of the seats is such that diametrically spaced portions of the top coils of the coil springs overlap the transversely extending portions of the seats when engaged therewith. Such overlapping portions of the top coils include downwardly offset portions which prevent longitudinal shifting of the top coils relative to their seats. In addition, the transverse spacing of the longitudinally extending portions of the seats is such that diametrically spaced portions of the top coils are disposed closely adjacent to and are confined between the longitudinally extending portions of their seats. Consequently, the top coil of each coil spring is prevented from shifting either longitudinally or transversely relative to its seat when engaged therewith. The top coils of each coil spring are further confined against transverse movement, relative to their seats, by downwardly offset portions which underlap transversely extending locking wires positioned between the transversely extending wires of each row of seats.

Referring now to FIG. 1, a spring unit and support frame assembly for a full size box spring is illustrated and indicated generally at 10. The spring unit portion of the assembly 10, which is indicated generally at 11 and which embodies the features of the present invention, is an improvement over the woven spring unit disclosed in the Rakow et al U.S. Pat. No. 4,068,330. This patent was granted on Jan. 17, 1978 and is assigned to the assignee of this application.

The spring unit 11 includes a grid structure, indicated generally at 12, which also embodies the features of the present invention. The grid 12 serves as a mounting for the top coils 13 of a plurality of coil springs 14, only three of which are illustrated in full lines in FIG. 1. The top coils of the other springs of the spring unit 11 are represented in phantom lines in FIG. 1 and illustrate one exemplary arrangement of the coil springs in a box spring having seventy-two springs. Each of the coil springs 14, in the present instance, is of a generally tapered helical configuration, the top coil 13 of which is the largest and the remaining coils being of progressively smaller diameter and arranged in a spiral terminating in a lower coil 16 which is stapled or otherwise secured to a support frame, indicated generally at 17, of the assembly 10. Coil springs having other than a tapered helical configuration could also be used.

The frame 17 includes a pair of spaced, parallel, longitudinally extending side frame members, each indicated at 18, and a pair of transversely extending, longitudinally spaced end frame members, each indicated at 19. A longitudinally extending frame member 22 is disposed centrally between the side frame members 18 and a plurality of laterally extending cross frame members 23 extend between the side frame members 18 in parallel, spaced relation.

Figure 5:
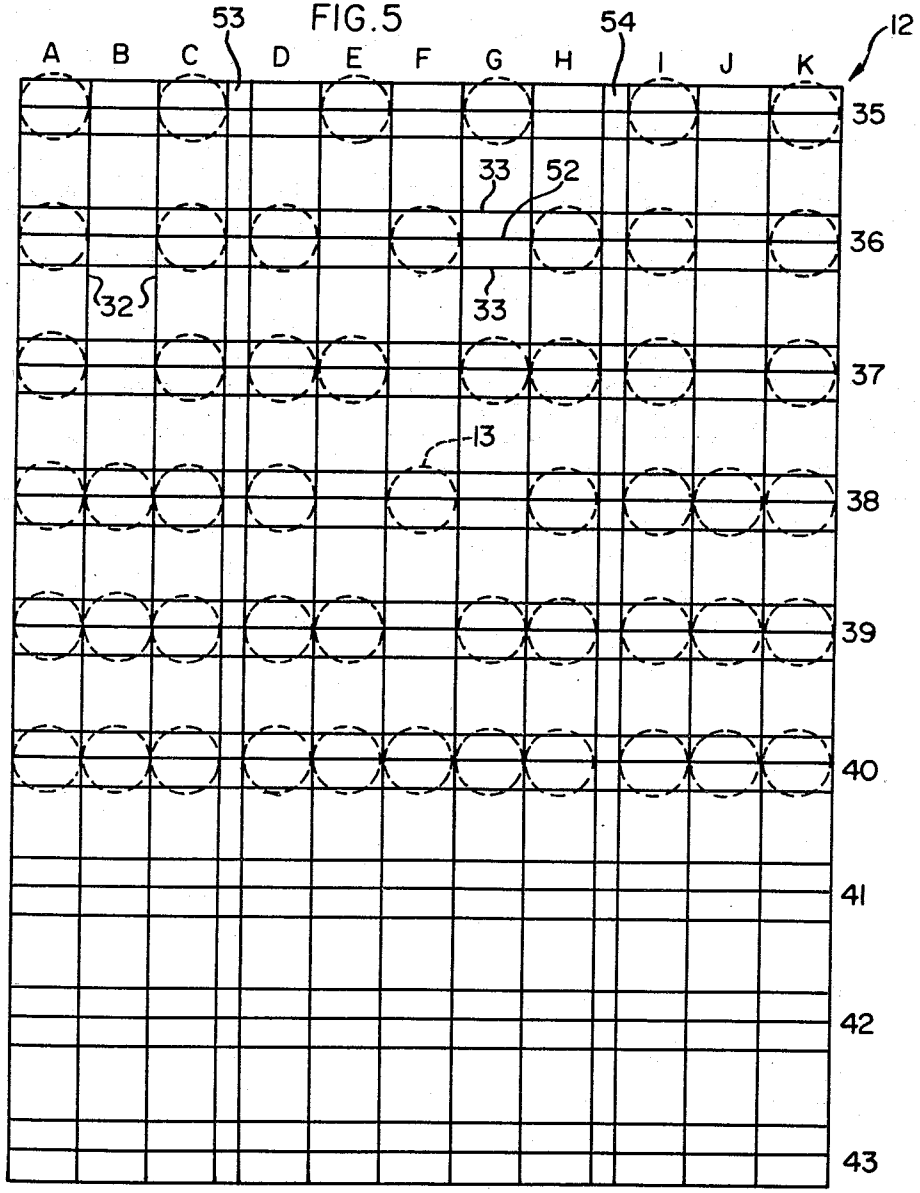
FIG. 5 is a diagrammatic plan view of a grid structure for a full size box spring foundation unit and embodying the features of the present invention.

Referring now to FIGS. 2 and 5 in conjunction with FIG. 1, it will be seen that the grid 12 comprises a first group of longitudinally extending wires, some of which are each indicated at 32, and a second group of wires extending transversely to the first group. Some of the second group of wires are each indicated at 33. In the case of the grid 12, which is sized for use in a spring unit for a full size box spring foundation unit, the transversely extending wires 33 overlie the longitudinally extending wires 32, the groups of wires 32 and 33 being connected together at their crossings as by welding (not shown).

The outermost longitudinally and transversely extending wires of the grid 12 are secured at various points, as by clips 25, to a generally rectangularly-shaped, heavier gauge border wire 26, which overlies the outer wires of the grid. The border wire 26 includes longitudinally spaced, transversely extending portions **26*a* and 26*b*, and transversely spaced, longitudinally extending portions 26*c* and 26*d*, respectively. The corners, each indicated at 27, of the grid are bent over the corners of the border wire 26, as shown in FIG. 1**.

The longitudinally and transversely extending groups of wires 32 and 33 are arranged in parallel, spaced relation so as to define a plurality of generally rectangular seats on the grid 12, which are arranged in rows and columns and which receive and retain the top or upper end coils 13 of the coil springs 14 so that the springs are maintained in a predetermined spatial arrangement. In the case of the grid 12, the length and width dimensions of the groups of wires 32 and 33 are equal to predetermined dimensions such that the dimensions of the foundation unit in which the grid is employed are substantially equal to those of a standard, full size, box spring foundation unit. Thus, nine longitudinally spaced rows of seats are provided by the grid 12, respectively indicated at 35–43, inclusive, in FIG. 5, there being eleven seats in each row in order to provide symmetry when different numbers of coil springs are used. The seats in each row, reading from left to right, are indicated by the letters A–K, inclusive.

As best seen in FIG. 2, the transverse spacing between the longitudinally extending wires 32 in each of the columns of seats A–K and the outside diameter of the top coils 13 of each spring 14 is such that diametrically spaced portions, indicated at 46 and 47, of each top coil are disposed closely adjacent to or engage longitudinally extending portions of their seats. The top coils are confined between the wires 32 and are prevented from shifting transversely relative to their seats. Because of the aforementioned diametric relationship between the top coils 13 and longitudinal wires 32 of each seat, top coils may be engaged with adjacent seats in each row and, when so engaged, will be separated from each other by the thickness of one longitudinally extending wire 32.

In order to prevent longitudinal shifting of the top coils 13 of each spring relative to its seat when the coils are engaged with the grid, the longitudinal spacing between the wires 33 of each row is such that diametrically spaced portions 48 and 49 of each top coil overlap the transversely extending wires 33 of each row and the portions 48 and 49 are downwardly offset so as to engage the outer sides of the portions of the wires 33 which define the seats, as shown in FIG. 4. The downwardly offset portions 48 and 49 of the coils, which are disposed adjacent to the head and foot portions **26*a* and 26*b* of the border wire, engage the outer sides of the portions 26*a* and 26*b*, respectively. This relationship is illustrated by the coil 14*a* in FIG 1. The downwardly offset portions 48 and 49** may be formed by providing V-shaped indentations in each top coil and comprise retaining means coacting with the transversely extending portions of the seats to prevent longitudinal shifting of the top coils relative to the seats.

In order to improve the interlock between the top coils 13 and their seats, the diametrically spaced portions 46 and 47 of each top coil may be downwardly offset so as to underlap a transversely extending locking wire 52, which is centrally disposed between the pairs of transversely extending wires 33 that define the seats for the top coils. The downwardly offset portions 46 and 47 may likewise be formed by V-shaped indentations in the top coils 13, in the same manner as the downwardly offset portions 48 and 49. The downwardly offset portions 46 and 47 thus also form part of the retaining means preventing longitudinal shifting of the top coils relative to their seats.

Referring again to FIG. 5, the universality of the grid 12 which permits its use in spring units having different numbers of coil springs so as to vary the degree of firmness of the foundation unit, will now be described. As previously mentioned, the grid 12 includes nine rows of seats with eleven seats in each row. In the present instance, the total width of the eleven seats in each row is less than the transverse width of the grid. Consequently, an empty space will be present in each row, which has a width that is somewhat less than the transverse width of one seat. For example, assuming that the total width of the grid 12 is about 52 inches (132 cm.), and assuming that the transverse width of each seat is about 4-7/16 inches (11.27 cm.) an empty space of about 3-3/16 inches (8.096 cm.) will result in each row. This space is preferably divided into two parts so that two spaces are located between two pairs of seats. In the present instance, the two spaces are indicated at 53 and 54 in FIG. 5 and located between the columns C and D and H and I, respectively. Thus, the two empty spaces 53 and 54 divide the seats in the grid into one centrally located set of five seats and two sets of seats on each side of the central set containing three seats each.

Because the seats in the grid 12 have a transverse width somewhat greater than the outside diameter of the top coils 13 of the coil springs 14, a plurality of the seats utilize common portions of the longitudinally extending wires 32. In other words, the transverse boundary between a number of the adjacent pairs of seats in each row is defined by only one longitudinal wire 32. Consequently, the number of wires 32 that are needed to provide the desired number of seats in the grid 12 is minimized, and a reduction in the weight and unit cost of the spring unit and foundation unit is likewise obtained.

As previously mentioned, the grid structure 12 permits different numbers of coil springs to be engaged with selected seats of the grid in order to vary the firmness of the spring unit 11 and consequently of the completed foundation unit. Thus, as will be apparent from FIG. 5, if a manufacturer wishes to produce a box spring foundation unit having fifty-four springs, he need only engage coil springs with the seats in columns A, C, E, G, I and K of each row. This arrangement is illustrated by the broken line positions of the top coils 13 of the springs in row 35.

Progressively firmer foundation units can be produced by engaging greater numbers of coil springs with the seats of the grid. Thus, if the arrangement of coil springs illustrated in rows 36, 37, 38, 39 or 40 is duplicated in all of the rows, then foundation units will result having total spring counts of 63, 72, 81, 90 or 99 springs, respectively. Thus, the grid structure 12 permits a manufacturer to produce full size box spring foundation units having spring counts of either 54, 63, 72, 81, 90 or 99 springs with only a single grid structure.

Referring now to FIG. 6, another grid structure embodying the features of the present invention is illustrated and indicated generally at 62. Like reference numerals and letters have been used, where applicable, to identify parts of the grid 62 identical to or in common with the grid structure 12.

The grid 62 is sized to provide a spring unit for a twinsize box spring foundation unit and is generally constructed in the same manner as the grid 12. Thus, the grid structure 62 includes a plurality of longitudinally and laterally extending wires 32 and 33 which define a plurality of generally rectangular seats on the grid for receiving and retaining the top coils 13 of a plurality of coil springs, such as the coil springs 14 employed in the spring unit 11. The top coils 13 of the coil springs 14 are connected to the seats of the grid structure 62 in the same manner as the coil springs 14 of the spring unit 11. The lower coils of the coil springs which are connected to the seats of the grid structure 62 may be secured to a support frame, such as the support frame 17 of the assembly 10.

As in the grid structure 12, the grid structure 62 permits different numbers of coils springs to be engaged with selected seats of the grid in order to vary the firmness of the spring unit and consequently of the completed foundation unit. The grid structure 62 thus includes nine longitudinally spaced rows of seats, respectively indicated at 35–43, inclusive, there being seven seats in each row in order to provide symmetry when different numbers of coil springs are used. The seats in each row are likewise arranged in columns, indicated by the letters A–G, respectively.

Since seven seats are provided in each of the rows 35–43, and since the total width of the grid 62 is preferably about 37 inches (93.98 cm.), if the transverse width of each seat is about 4-7/16 inches (11.27 cm.), an empty space is provided in each row of seats. This empty space is about 5-15/16 inches (15.08 cm.) and is preferably divided into two spaces, indicated at 63 and 64 and disposed between the columns A and B and F and G, respectively, of the grid. The empty spaces 63 and 64 are about 2-31/32 inches (7.54 cm.) wide and divide the seats in the grid into one centrally located set and two sets disposed on each side of the central set containing one seat each.

Assuming that a manufacturer wishes to produce a twinsize spring unit and support frame assembly having different degrees of firmness, different numbers of coil springs are engaged with the seats in the rows 35–43. Thus, if a manufacturer wishes to produce a box spring foundation unit having thirty-six springs, coil springs are engaged with the seats in rows 35–43, inclusive, in the manner illustrated in row 35 of FIG. 6. If progressively firmer foundation units are desired, the coil spring arrangements illustrated in rows 36, 37 or 38 of FIG. 6 can be duplicated in all of the rows and will result in foundation units having spring counts of 45, 54 or 63 springs, respectively. Thus, the grid 62 permits a manufacturer to produce a twin-size spring unit and box spring foundation unit having either 36, 45, 54 or 63 coil springs with only one grid structure.

Figure 7:
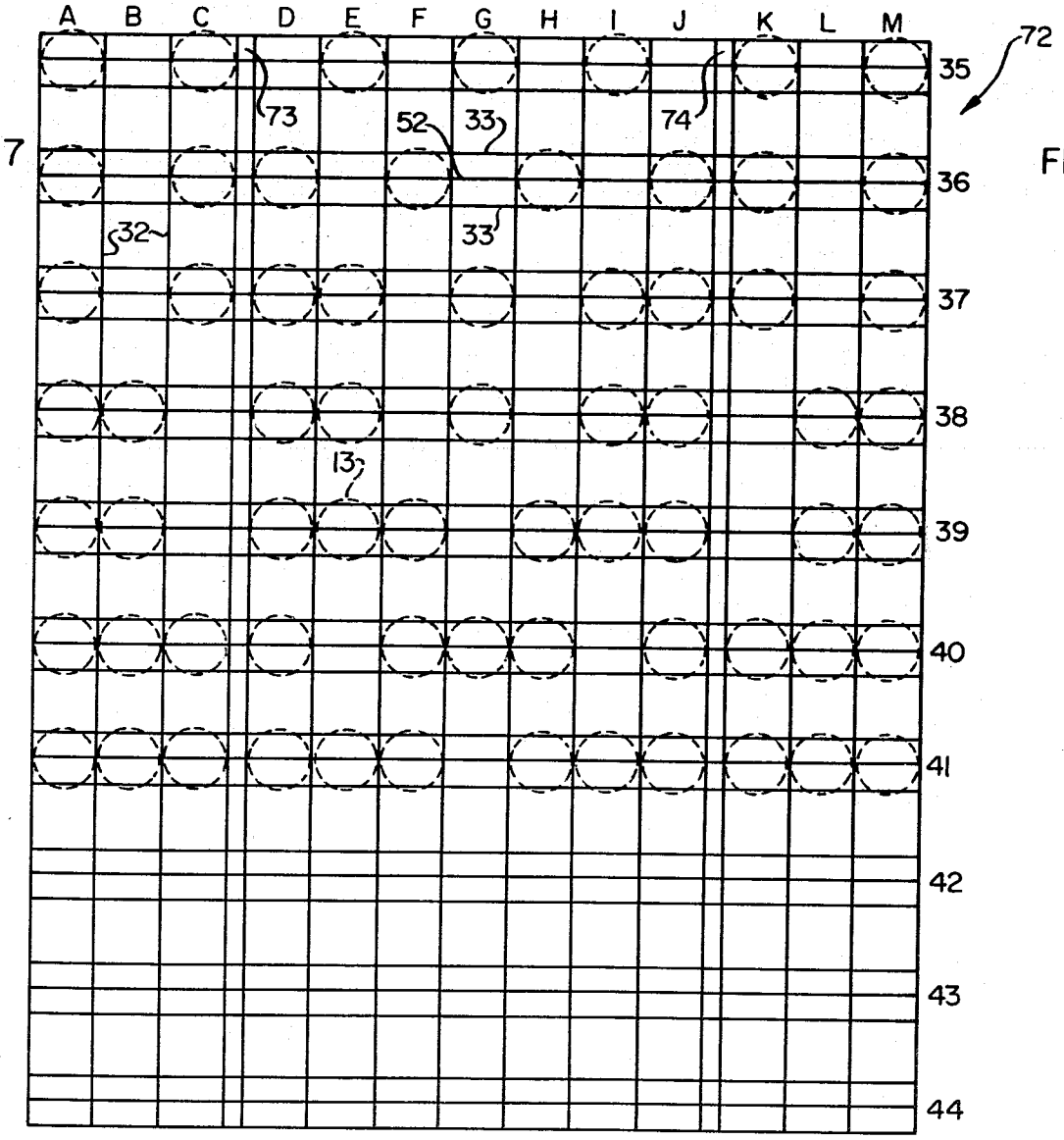
FIG. 7 is a diagrammatic plan view of another grid structure for a queen size box spring foundation unit and embodying the features of the present invention.

Referring now to FIG. 7, another grid structure embodying the features of the present invention is illustrated and indicated at 72. Like reference numerals and letters have been used, where applicable, to identify parts of the grid 72 which are either identical to or in common with the grid structures 12 and 62.

The grid structure 72 is sized to provide a spring unit for a queen-size box spring foundation unit and is generally constructed in the same manner as the previous grid structures. Thus, the grid 72 includes a plurality of longitudinally and laterally extending wires 32 and 33 which define a plurality of generally rectangular seats on the grid for receiving and retaining the top coils of a plurality of coil springs, such as the top coils 13 of the coil springs 14 of the spring unit 11. The lower coils of the coil springs are secured to an appropriately sized support frame (not shown), such as the support frame 17 of the spring unit and support frame assembly 10.

As in the previous embodiments, the grid structure 72 is capable of receiving and retaining different numbers of coil springs in predetermined spatial relationships so that foundation units can be produced with different degrees of firmness. To this end, the grid structure 72 includes 10 rows of longitudinally spaced seats, there being 13 seats in each row in order to provide symmetry when different numbers of coil springs are utilized. Since the total width of the seats in each row of the grid 72 is less than the transverse width of the grid, an empty space is present in each row. For example, assuming that the width of the grid 72 is about 59 inches (149.86 cm.) and assuming that the transverse width of each seat is approximately 4-7/16 inches (11.27 cm.) an empty space of approximately 1-5/16 inches (3.33 cm.) will be present in each row. This space is preferably divided into two parts so that two spaces, indicated at 73 and 74, respectively, having widths of approximately 21/32 inches (1.66 cm.) each, are obtained. The spaces 73 and 74 are preferably located between the columns of seats C and D and J and K, respectively, but could be located elsewhere. Thus, the two empty spaces 73 and 74 divide the seats in the grid 72 into a centrally located set containing seven seats and two adjoining sets of seats, each containing three seats.

As in the previous embodiments, a plurality of the longitudinally extending wires 32 of the grid 72 are common to adjacent pairs of seats. Consequently, a minimum number of the wires 32 is required to provide a desired number of seats on the grid 72 for a queen-size box spring foundation unit, and the weight and cost of the spring unit with which the grid 72 is used, is also reduced.

As in the previous embodiments, the grid structure 72 permits different numbers of coil springs to be engaged with different numbers of seats in each row of the grid in order to vary the firmness of the spring unit assembly and completed foundation unit. Thus, if it is desired to produce a queen-size foundation unit having seventy coil springs, springs need only be engaged with the seats in columns E, G and I of the central set of seats in each row, and with the seats in columns A, C, K and M in the two sets of seats in each row adjacent to the central set. This arrangement is illustrated by the broken line positions of the top coils 13 of the springs shown in row 35 of FIG. 7.

Progressively firmer foundation units can be produced by engaging greater numbers of coil springs with the seats of the grid. Thus, if the arrangement of coil springs illustrated in rows 36, 37, 38, 39, 40 or 41 is duplicated in all of the rows of the grid, then foundation units will result having total spring counts of 80, 90, 90, 100, 110 or 120 springs, respectively. Thus, the grid structure 72 permits a manufacturer to produce queen-size box spring foundation units having spring counts of either 70, 80, 90, 100, 110 or 120 springs with only a single grid structure.

Figure 8:
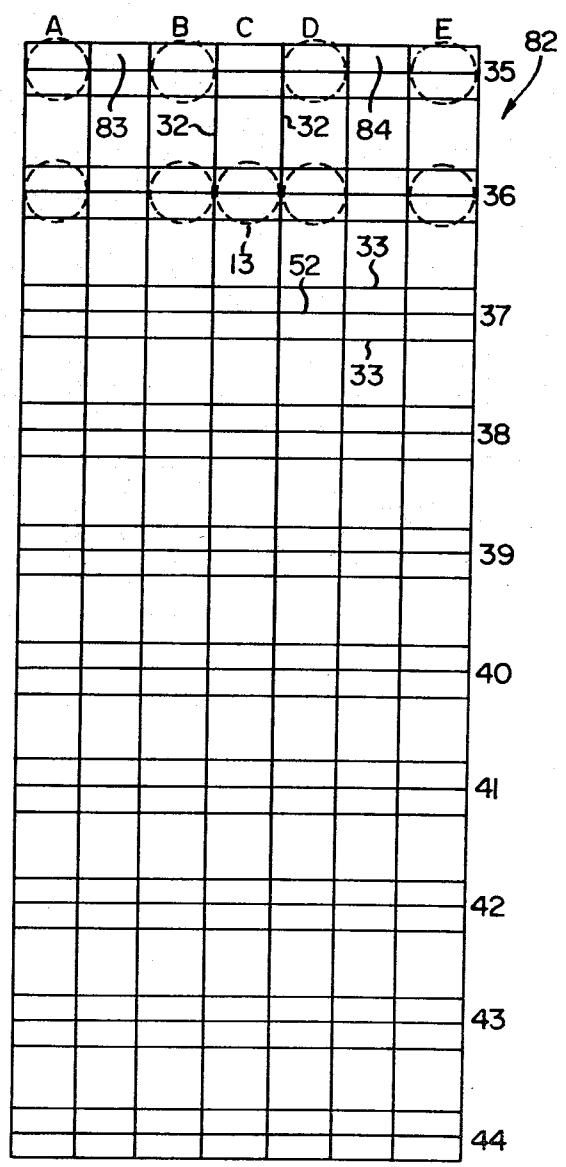
FIG. 8 is a diagrammatic plan view of another grid structure for a half-queen size box spring foundation unit and embodying the features of the present invention.

In FIG. 8, another grid structure embodying the features of the present invention is illustrated and indicated generally at 82. Like reference numerals and letters have been used, where applicable, to identify the parts of the grid 82 which are identical to or in common with those of the grid structure 12.

The grid structure 82 is sized to provide a spring unit for a half-queen size box spring foundation unit and is generally constructed in the same manner as the grid structures 12, 62 and 72. The grid 82 thus includes a plurality of longitudinally and laterally extending wires 32 and 33, which define a plurality of generally rectangular seats on the grid for receiving and retaining the top coils of a series of coil springs, such as the top coils 13 of the coil springs 14 of the spring unit 11. The top coils of the coil springs are connected to the seats of the grid 82 in the same manner as the coil springs 14 of the spring unit 11. The lower coils of the coil springs may be secured to a support frame (not shown), such as the support frame 17 of the spring unit and support frame assembly 10.

As in the previous embodiments, the grid structure 82 is capable of receiving and retaining different numbers of coil springs in predetermined spatial relationships so that foundation units can be produced having different degrees of firmness. To this end, the grid structure 82 includes ten rows of longitudinally spaced seats, there being five seats in each row in order to provide symmetry when different numbers of coil springs are utilized. Since the total width of the seats in each row of the grid 82 is less than the transverse width of the grid, an empty space is present in each row. For example, assuming that the width of the grid 82 is about 29 inches (73.66 cm.) and assuming that the transverse width of each seat is approximately 4-7/16 inches (11.27 cm.), an empty space of approximately 6-13/16 inches (17.3 cm.) will be present in each row. This space is preferably divided into two spaces, indicated at 83 and 84, of approximately 3-13/32 inches (8.65 cm.) each and located between the columns of seats A and D and E, respectively. The empty spaces 83 and 84 thus divide the seats in the grid 82 into a centrally located set containing three seats and two adjoining sets, each containing one seat.

As in the previous embodiments, a plurality of longitudinally extending wires 32 of the grid 82 are common to adjacent pairs of seats in each row. Consequently, a minimum number of the wires 32 is required to provide a desired number of seats on the grid 82 for a half-queen size box spring foundation unit, with a corresponding reduction in the weight and cost of the spring unit with which the grid 82 is used.

The grid structure 82 also permits different numbers of coil springs to be engaged with different numbers of seats in each row of the grid in order to vary the firmness of the spring unit and completed foundation unit. Thus, if it is desired to produce a half-queen size foundation unit having forty coil springs, the top coils of such springs need only be engaged with the seats in columns B and D of the central set and with the seat in columns A and E of the two sets of seats adjacent to the central set. This arrangement is illustrated by the broken line position of the top coils 13 in row 35 of FIG. 8.

A firmer foundation unit can be produced if an additional coil spring is engaged with the seats in column C of each row, in addition to the springs in columns A, B, D and E. This arrangement is illustrated by row 36 of FIG. 8 and results in a spring unit having a total spring count of fifty springs. Thus, the grid 82 permits a manufacturer to produce half-queen size box spring foundation units having spring counts of forty or fifty with only a single grid structure.

From the foregoing, it will now be apparent that the grid structures herein illustrated and described permit a manufacturer of spring units, such as the unit 11, to supply spring units to customers in standard sizes and with different numbers of coil springs so that box spring foundation units, mattresses, and other types of upholstered furniture can be produced having different degrees of firmness. However, the spring unit manufacturer need only stock grids constructed in the manner of the grids 12, 62, 72 and 82, and correspondingly sized wooden support frames, since different numbers of coil springs can be engaged with each size grid and frame. The spring unit manufacturer thus does not have to maintain a large inventory of grids having different seat arrangements and a large inventory of wooden support frames suited for use with each type of grid. Consequently, substantial savings may be realized by the spring unit manufacturer due to reduced inventories and storage space requirements. Moreover, because the transverse width of the seats in each row is somewhat greater than the outside diameter of the top coils 13 of the coil springs 14, most of the top coils are separated from each other by the thickness of only one longitudinally extending wire 32. Savings may thus also be realized as a result of a reduction in the amount of wire needed to construct the grids.

It should be understood that, while the grids 12 and 62, have been herein illustrated and described as having nine longitudinally spaced rows of seats, and while the grids 72 and 82 have been herein illustrated and described as having ten longitudinally spaced rows of seats, respectively, more or less than these numbers of rows could be employed in each grid. In addition, the longitudinal spacing of the various rows of seats in each grid does not have to be uniform but could be reduced at the central portion of the grid in order to increase spring concentration and firmness of the spring unit in this area.

Moreover, while the grids 12, 62, 72 and 82 have been herein illustrated and described as having an odd number of seats in each row, an even number of seats could also be provided. Thus, where an even number of seats are provided in each row and an odd number of springs are engaged with the seats in each row, substantial symmetry could be obtained by alternating the position of the odd spring in each row, with respect to the transverse center of the grid, between adjacent rows. Where an even number of seats are provided in each row and an even number of springs are engaged with the seats in each row, substantial symmetry could likewise be obtained by alternating the positions of two of the springs in each row, with respect to the transverse center of the grid, between adjacent rows and so that each of the two springs in each row are equidistantly spaced from the transverse center of the grid.

It should be understood that, while the spaces 53, 54; 63, 64; 73, 74 and 83, 84 have been illustrated and described as being in certain locations in the grids 12, 62, 72 and 82, such spaces could occupy different locations in the grids. Moreover, one or both of the spaces 53, 54; 63, 64; 73, 74 and 83, 84 could be eliminated if the transverse width of the seats in each row were changed so that the total width of the seats was equal to the width of their respective grids.

It should also be understood that, while certain specific locations of the coil springs 14 on the seats of the grids 12, 62, 72 and 82 have been herein illustrated and described, other arrangements are also possible.

Throughout the specification, the transverse width of each seat in the grids 12, 62, 72 and 82 has been described as being about 4-7/16 inches (11.27 cm.), other widths, such as 4½ inches (11.43 cm.), for example, could also be used. Accordingly, the latter seat width is within the purview of the present invention.

While several embodiments of the invention have been herein illustrated and described, it will be understood that modifications, variations and equivalents thereof may be developed without departing from the spirit of the invention as defined in the appended claims.

I claim:

1. A grid for engaging and supporting a plurality of coil springs in a predetermined spatial relationship to provide a spring unit adapted for use in a box spring foundation unit or the like, said grid comprising a first group of longitudinally extending wires and a second group of wires extending transversely to said first group, said second group of wires being connected to said first group at their crossings and defining a plurality of generally rectangular seats adapted to receive and retain the top coils of said coil springs so that said springs are maintained in said predetermined spatial arrangement, said seats being arranged in rows and columns, and the transverse width of each seat being greater than the diameter of the top coils of said coil springs so that said top coils do not overlap and are confined between the longitudinally extending portions of their respective seats when engaged therewith, and the length and width of said grid having predetermined dimensions such that the dimensions of the foundation unit in which said grid is employed are substantially equal to the standard dimensions for such a unit, whereby different numbers of coil springs may be engaged with selected seats of said grid so that the firmness of the foundation unit can be varied.

2. The grid of claim 1, in which nine longitudinally spaced rows of seats are defined by said first and second groups of wires.

3. The grid of claim 1, in which ten longitudinally spaced rows of seats are defined by said first and second groups of wires.

4. The grid of claim 1, in which at least one empty space is provided between the seats in each row.

5. The grid of claim 1, in which at least two spaces are provided in each row of seats so as to divide the seats in each row into three sets.

6. The grid of claim 4 or 5, in which the empty spaces in said rows of seats are in longitudinal alignment.

7. The grid of claim 5, in which one of the three sets of seats in each row has at least five seats.

8. The grid of claim 7, in which said five seats are adjacent to each other.

9. The grid of claim 8, in which three of the seats of said one set utilize common portions of said first group of longitudinally extending wires.

10. The grid of claim 5, in which said five adjacent seats are positioned substantially centrally in each row.

11. The grid of claim 7, in which two of the sets of seats in each row has one seat and either four, five, six or seven springs may be engaged with the seats in each row.

12. The grid of claim 11, in which either two, three, four or five springs may be engaged with the seats of said one set in each row.

13. The grid of claim 12, in which said predetermined dimensions are substantially equal to the length and width of a standard, twin-size box spring foundation unit.

14. The grid of claim 7, in which two of the three sets of seats in each row have three seats and either six, seven, eight, nine, ten or eleven springs may be engaged with the seats in each row.

15. The grid of claim 14, in which said three seats are adjacent to each other.

16. The grid of claim 14, in which either two, three, four, or five springs may be engaged with the seats of said one set and either two or three springs may be engaged with the seats of said other two sets.

17. The grid of claim 14, in which said predetermined dimensions are substantially equal to the length and width of a standard full size box spring foundation unit.

18. The grid of claim 5, in which one of the three sets of seats in each row has seven seats.

19. The grid of claim 18, in which said seven seats are adjacent to each other.

20. The grid of claim 18, in which five of the seats of said one set utilize common portions of said first group of longitudinally extending wires.

21. The grid of claim 18, in which said seven adjacent seats are positioned substantially centrally in each row.

22. The grid of claim 18, in which two of the sets of seats in each row has three seats and either seven, eight, nine, ten, eleven, twelve or thirteen springs may be engaged with the seats of each row.

23. The grid of claim 22, in which either three, four, five or six springs may be engaged with the seats of said one set in each row in symmetrically arranged relation.

24. The grid of claim 18, in which said predetermined dimensions are substantially equal to the length and width of a queen size box spring foundation unit.

25. The grid of claim 1, in which seven seats are provided in each row and five of the seats of each row utilize common portions of said first group of longitudinally extending wires.

26. A spring unit adapted for use in a box spring foundation unit for supporting a mattress, said spring unit comprising a top grid having a first group of longitudinally extending wires and a second group of wires extending transversely to said first group, said first and second groups of wires being connected at their crossings and defining a plurality of generally rectangular seats, and a plurality of coil springs having substantially circular top coils engaged with said seats, said top coils each having retaining means coacting with the transversely extending portions of said seats to prevent longitudinal shifting of said top coils relative to said seats, the outside diameter of said top coils being substantially equal to the transverse spacing between the longitudinally extending portions of said seats so that diametrically spaced portions of each of said top coils engage longitudinally extending portions of said seats and prevent transverse shifting of said top coils relative to said seats, whereby said top coils are restrained against longitudinal and lateral movement relative to said seats and said coils are maintained in a predetermined spatial arrangement in said spring unit.

27. The spring unit of claim 26, in which said retaining means comprises a pair of diametrically spaced, downwardly offset portions of each of said top coils, and said downwardly offset portions engage the outer sides of the transversely extending portions of said seats.

28. The spring unit of claim 27, in which said downwardly offset portions comprise longitudinally spaced indentations in each of said top coils.

29. The spring unit of claim 28, in which each of said longitudinally spaced indentations is generally V-shaped.

30. The spring unit of claim 28, in which said second group of wires overlies said first group of wires, said top grid includes a transversely extending locking wire disposed between pairs of said second group of wires, each of said top coils includes another pair of diametrically spaced, downwardly offset portions adjacent to the longitudinally extending portions of said seats, and said other pair of downwardly offset portions underlap said locking wires, whereby said top coils are additionally restrained against longitudinal movement relative to said seats by the underlapping engagement of said other pair of downwardly offset portions with said locking wires.

31. The spring unit of claim 30, in which said other pair of downwardly offset portions comprise transversely spaced indentations in each of said top coils.

32. The spring unit of claim 31, in which each of said transversely spaced indentations is generally V-shaped.

* * * * *